US007775394B2

(12) United States Patent
Naesje

(10) Patent No.: US 7,775,394 B2
(45) **Date of Patent: *Aug. 17, 2010**

(54) OPENING-FORCE-MAXIMIZING DEVICE OF AN UNDERPRESSURE-ACTIVATED VALVE FOR A DRINKING CONTAINER

(75) Inventor: Kjetil Naesje, Sandnes (NO)

(73) Assignee: SmartSeal AS (NO)

( * ) Notice: Subject to any disclaimer, the term of this patent is extended or adjusted under 35 U.S.C. 154(b) by 1497 days.

This patent is subject to a terminal disclaimer.

(21) Appl. No.: 10/533,257

(22) PCT Filed: Oct. 29, 2003

(86) PCT No.: PCT/NO03/00361

§ 371 (c)(1),
(2), (4) Date: Apr. 29, 2005

(87) PCT Pub. No.: WO2004/039690

PCT Pub. Date: May 13, 2004

(65) Prior Publication Data

US 2006/0043096 A1 Mar. 2, 2006

(30) Foreign Application Priority Data

Oct. 29, 2002 (NO) ..... 20025193

(51) Int. Cl.
*A47G 19/22* (2006.01)
*B65D 35/38* (2006.01)

(52) U.S. Cl. ..... 220/714; 220/717; 220/203.11; 215/11.4; 215/387; 222/568; 137/455

(58) Field of Classification Search ..... 215/387, 215/11.4; 220/714, 717, 203.11; 222/494, 222/422; 137/455
See application file for complete search history.

(56) References Cited

U.S. PATENT DOCUMENTS

| | | | | |
|---|---|---|---|---|
| 5,607,073 | A * | 3/1997 | Forrer | 215/11.4 |
| 6,176,380 | B1 * | 1/2001 | Glories et al. | 215/11.1 |
| 6,332,730 | B1 * | 12/2001 | Taghavi-Khanghah | 401/264 |
| 6,662,977 | B2 * | 12/2003 | Gerber et al. | 222/494 |
| 7,419,069 | B2 * | 9/2008 | Naesje | 220/714 |
| 2004/0144792 | A1 * | 7/2004 | Naesje | 220/714 |

* cited by examiner

*Primary Examiner*—Robin Hylton
(74) *Attorney, Agent, or Firm*—Andrus, Sceales, Starke & Sawall, LLP

(57) ABSTRACT

An opening-force-maximizing device of an underpressure-activated valve for a drinking container (2). The device includes a partition wall (6, 106, 206) enclosing an outlet opening (4) and being provided with a wall opening (8, 108, 208) in pressure-sealing contact with an axially movable valve sealing member (22, 122, 222) being in position of rest. It also includes a continuous membrane (12, 112, 212) being arranged to the container (2) and about a valve axis (14) through the wall opening (8, 108, 208). The membrane (12, 112, 212) has an axial extent and consists of an attachment end (12*a*, 112*a*, 212*a*) fixedly connected to the partition wall (6, 106, 206), and a movable maneuvering end (12*b*, 112*b*, 212*b*) placed at an axial distance from the attachment end (12*a*, 112*a*, 212*a*). The maneuvering end (12*b*, 112*b*, 212*b*) is arranged in a tensile-force-transmitting manner to said sealing member (22, 122, 222). By arranging the membrane (12, 112, 212) with a maximum longitudinal extent when at rest in its inactive position, and by being arranged radially flexible and deflectable and also being arranged in a manner inhibiting axial stretching, a maximum valve opening force is achieved when underpressure-activated.

19 Claims, 6 Drawing Sheets

OPENING-FORCE-MAXIMIZING DEVICE OF AN UNDERPRESSURE-ACTIVATED VALVE FOR A DRINKING CONTAINER

CROSS REFERENCE TO RELATED APPLICATION

The present application is the U.S. national stage application of International Application PCT/NO2003/000361, filed Oct. 29, 2003, which international application was published on May 13, 2004 as International Publication WO 2004/039690. The International Application claims priority of Norwegian Patent Application 20025193, filed Oct. 29, 2002.

BACKGROUND OF THE INVENTION

The present invention relates to an opening-force-maximizing device of an underpressure-activated, self-adjusting valve for a drinking container. The container may contain a pressurized or non-pressurized soft drink or other liquefied article of food. The device is intended for use in connection with a drinking spout for the container.

Underpressure-activated devices for automatic opening of drinking valves are known from previous patent publications, including U.S. Pat. No. 6,290,090. The opening mechanism according to U.S. Pat. No. 6,290,090 includes a pressure-responsive membrane for activating a valve of a drinking can containing a carbonated, pressurized drink. The valve allows for spill-free consumption of the contents of the can. The membrane, which forms a maneuvering member of the drinking valve, is concentric and formed approximately planar about the longitudinal axis of the drinking can, said plane being perpendicular to the longitudinal axis. The membrane is also fixedly attached along its entire circumference. A flow-through stay, which is a part of a sealing member of the valve, connects the membrane to the sealing member, which opens or closes an outlet opening of the can. The membrane is activated when a user sucks an underpressure on one side of it, thereby creating a differential pressure across the membrane. The differential pressure generates a pressure force moving the membrane and the sealing member in an axial and valve-opening direction. As the activating surface of the membrane is larger than the valve surface covering the outlet opening, a valve opening force is produced and transmitted, which may be sufficiently large for the valve to open, even at a given overpressure in the can.

To use this type of membrane structure for opening a valve of a drinking container of pressurized liquid, involves several weaknesses:

Inasmuch as the peripheral regions of the planar membrane according to U.S. Pat. No. 6,290,090 are secured and thereby may move insignificantly during said pressure influence, mainly the central portion of the membrane is axially moveable. The effective, pressure-responsive membrane surface area thus is reduced, causing relatively insignificant force to be transmitted to the valve sealing member. Increasing the area of the membrane in the radial direction may solve this problem. However, such a solution is not possible when used in standard bottle caps, in which the membrane diameter is limited by the cap diameter. The user may, however, compensate for a reduced, effective membrane area and attenuated pressure force by increasing the suction force on the membrane. However, the user must use a disproportionately large suction force, especially during incipient opening of the valve when the drinking can is pressurized. This valve device may not be perceived as being very functional and user-friendly.

Moreover, this membrane structure is not provided with bracing elements that concentrate and transmit the membrane pressure force to the valve sealing member.

Nor is the membrane structure arranged with any opening-force-maximizing device that limits the incipient suction force required during valve-opening of a pressurized drinking can.

The sealing member is also placed on the downstream side of the can's outlet opening, allowing it to open automatically at a given overpressure in the drinking can. Its liquid contents thus will flow out of the can unintentionally. If this unintended effect is to be avoided, the valve must only be used on drinking cans containing non-carbonated drinks, which defies the object of the valve device according to U.S. Pat. No. 6,290,090. Possibly, the membrane must be reinforced or braced to avoid unintended outflow when the liquid contents is pressurized, whereby the user must supply additional suction force to the membrane. However, this further weakens the functionality and user-friendliness of the valve.

In connection with ordinary bottle caps and carbonated drinks, the main problem of this membrane structure therefore lies in its effective membrane area being too small to provide sufficient valve opening force, especially in the opening phase of the valve. For this reason, the valve device according to U.S. Pat. No. 6,290,090 will be experienced as not being very functional and not being very user-friendly.

SUMMARY OF THE INVENTION

The object of the present invention is to remedy the above-mentioned disadvantages of prior art.

The object is achieved by means of the features disclosed in is following description and the subsequent claims.

The present valve device is special in that it is arranged to transmit the largest opening force to the valve sealing member during the incipient phase of the valve-opening, even if the user employs a moderate underpressure to activate the valve device. This effect makes the valve user-friendlier, especially when the sealing member must open against an overpressure in the drinking container. When consuming carbonated drinks, for example, the pressure at the opening instant will always be larger than that of the following drinking phase. The valve device is also advantageous to persons having little suction force, including small children and some categories of disabled and sick persons.

In connection with a drinking spout for the container, particular embodiments of the valve device also provide great advantages during production thereof, cf. the following exemplary embodiments.

In principle, the valve device according to the invention operates by utilizing a tensile force arising along a sleeve-like body in the form of a membrane, and which is transmitted to the valve sealing member. The tensile force arises when the membrane is supplied a differential pressure and is deflected perpendicularly from its longitudinal direction. This causes an axial contraction of the membrane and a resulting axial movement of the sealing member.

The principle intended to be utilized in the present invention, and which will be described below, is best illustrated by the following analogy of a rope extended between its two end points. Said membrane deflection will proceed in approximately the same way as the extended rope will deflect perpendicular to its longitudinal direction when subjected to a lateral force "S". The rope analogy illustrates the forces utilized in the present valve device. The lateral force "S" on the rope results in a reactive tensile force "F" along the deflected rope. The tensile force "F" is transmitted to the attachment ends of the rope and is many times larger than the applied lateral force "S". By fixing one end of the rope, the tensile force "F" may be used to move the other end of the rope in the longitudinal direction (axial direction) of the rope. This effect is analogous to the effect of the present membrane structure. During the deflection, the tensile force "F" at either attachment end may be decomposed into an axial force component "$F_a$", which is parallel to the original axial direction of the rope prior to deflection, and a shear component "$F_s$", which is perpendicular to said axial direction. A deflection angle "a" existing between the original axial direction of the rope and its direction when deflected, will increase with increasing deflection. When the angle "a" increases, the magnitude of each force component "$F_a$" and "$F_s$" will change in accordance with general geometric considerations, hence in accordance with trigonometric functions. The force component "$F_a$" thus becomes a function of (cos "a"), whereas the shear component "$F_s$" becomes a function of (sin "a"), both functions being non-linear. The axial component "$F_a$" is at its largest when the deflection angle "a" is small, i.e. during the incipient phase of the deflection of the rope. The opposite relation applies to the shear force $F_a$. The deflection also results in a non-linear axial contraction of the rope. Under the circumstances depicted herein, the axial movement (contraction) of the rope will be the least during the incipient phase of the deflection, after which the axial movement increases.

Corresponding force and contraction considerations also are utilized in the present membrane structure. Inasmuch as the axial component "$F_a$" transmits and contributes a valve opening force to the sealing member, the maximum opening force will be transmitted during the incipient phase of the membrane deflection, when the deflection angle is at its smallest. This implies that the membrane structure causes a large opening force and small sealing member movement during incipient opening of the valve, whereas the force decreases and the sealing member movement increases afterwards. By utilizing the rope principle, the opening force of the valve may be increased considerably relative to existing valve opening mechanisms, and particularly at the onset of the sucking/drinking process when the overpressure in a carbonated drink container is at its largest.

In its position of use, the present valve device is connected to an outlet opening, for example a bottle opening, of the drinking container. Among other things, the valve device includes a partition wall covering and pressure-sealingly enclosing said outlet opening and separating the interior of the drinking container from the ambient environment. The partition wall is provided with a wall opening, the upstream side of which is in pressure-sealing contact with the valve sealing member when in a position of rest.

The valve device also includes a peripherally continuous membrane arranged about an axis onto said partition wall and through the wall opening. Inasmuch as the membrane is arranged with an axial extent relative to said axis, hereinafter referred to as a valve axis, it is provided with two axial termination ends, comprising one attachment end and one maneuvering end. In position of use, the attachment end is fixedly connected to said partition wall, whereas the maneuvering end is movable and placed at an axial distance from the attachment end. In a tensile-force-transmitting manner, the maneuvering end is arranged to a valve sealing member capable of opening or closing said partition wall opening. The maneuvering end may be connected to either a sealing member or an extension of the maneuvering end formed as a sealing member. Via its support, the sealing member is arranged axially movable relative to the wall opening. This membrane structure thus forms said sleeve-like membrane enclosing the valve axis and the sealing member, and the sleeve-like membrane for example being of a cylindrical and/or conical shape.

To prevent undesired access to the contents of the drinking container before consumption, the sealing member and an edge of the wall opening may be connected via a breakable seal that is broken upon first-time movement of the sealing member. Breaking such a seal, however, requires an additional force to be applied to the sealing member during incipient opening of the valve, the operation of which the present valve device is well suited for providing.

The present membrane is activated by means of a user sucking an underpressure on one side of the membrane, as with the membrane according to U.S. Pat. No. 6,290,090. Also, the present membrane is pressure-balanced against the ambient pressure of the container. The membrane activation thus may be carried out independently of the pressure inside the container. This distinguishes the present valve from, for example, a flap valve, which is pressure-balanced against the container pressure. Also, the drinking container is pressure-balanced against the ambient pressure.

The shape and method of attachment of the present membrane differ substantially from those of the device according to U.S. Pat. No. 6,290,090. The differences significantly affect the opening force sequence during opening of the valve, and particularly during its incipient opening.

As mentioned, the membrane according to U.S. Pat. No. 6,290,090 is of an approximately planar form and is attached along its circumference. When in position of rest, it therefore has no longitudinal extent axially. The valve-opening tensile force transmitted to the sealing member when activating the membrane, thus extends in the same direction as that of the differential pressure force on the membrane, i.e. perpendicular to the membrane. This causes the above-mentioned disadvantages, including weak opening force acting on the valve sealing member.

Inasmuch as the present membrane structure is provided with longitudinal extent axially, this implies that the effective, pressure-responsive area of the membrane may be increased by means of increasing the longitudinal extent of the membrane, but without increasing its radial extent. Thereby, the pressure force on the membrane may be increased without expanding the membrane radially. This is favourable in standard bottle caps, in which the radial extent of the membrane is limited by the cap diameter.

As a consequence of the present membrane structure, the perpendicular differential pressure onto the membrane is converted to a longitudinal valve opening force aimed in the general longitudinal direction of the sleeve-like membrane. Thereby, the opening force is essentially parallel to the longitudinal direction of the membrane, but approximately perpendicular to the direction of the differential pressure force.

For each axial section through the membrane, the longitudinal direction of the membrane is defined between its attachment end and its maneuvering end. In a cylindrical construction, the longitudinal extent of the membrane is parallel to the valve axis, whereas in a conical construction, for example, the membrane is not parallel to the valve axis. In the latter case, the longitudinal extent will provide at least one axial component and at least one radial component. Although the longitudinal direction of the membrane, hence the direction of the valve opening force, is not parallel to the valve axis, it is the axial component of the opening force parallel to the valve axis that provides axial movement of the sealing member relative to said wall opening.

Depending on the desired valve functionality and valve geometry, the membrane deflection may be carried out by allowing the membrane to deflect inwards towards the valve axis, or outwards from the valve axis. This is achieved either by arranging the membrane to deflect radially inwards towards the valve axis, the membrane thus assuming the form of an hour-glass, or by arranging the membrane to deflect radially outwards from the valve axis, the membrane thus swelling like a balloon. Thereby, said underpressure must be applied to the inside or the outside of the membrane sleeve, respectively. When an expandable membrane is used, its mid portion is preferably shaped as a longitudinal bellows having axially extending folds of a depth adapted for the desired degree of expansion.

Moreover, in order to transmit the largest incipient opening force in the longitudinal direction of the membrane construction and onwards to the valve sealing member, the sleeve-like membrane body must be arranged with a maximum longitudinal extent (measured along the valve axis) when at rest in its inactive position. Being at rest corresponds to said rope being in its extended and secured state before being subjected to the lateral force "S".

Incipient maximum force transmission is achieved only if said rope is arranged in a manner inhibiting axial stretching, the length of the rope thereby being insignificantly extensible at the relevant tensile loads. This property is provided through choice of material, dimensioning and/or structure of the relevant rope. Thus, highly elastic or plastically deformable ropes, including elasticity-ropes and rubber bands, are poorly suited. However, all ropes are elastic to some degree and will be subjected to a certain elastic stretching when subjected to tensile loads. The desired effect is therefore achieved by choosing a rope that exhibits n insignificant elastic stretching when subjected to the tensile load caused by the relevant side force "S".

Correspondingly, the present membrane must be arranged in a manner inhibiting axial stretching, the longitudinal extent of the membrane thereby being insignificantly extensible axially at the relevant tensile loads caused by said differential pressure acting on the membrane. This property is provided through skilled choice of material, dimensioning and/or construction of the relevant membrane. The chosen membrane must therefore be able to exhibit insignificant elastic longitudinal stretching at said tensile loads. For this reason, the membrane may not be easily stretchable in the axial direction. Consequently, it also may not be provided with one or more membrane-length-promoting deformations, for example concentric corrugations or folds, which allow axial extension of the membrane under the influence of an axial tensile force. If so, the incipient tensile force will extend the membrane material or its deformation zone(s) instead of being transmitted to the sealing member for movement thereof.

To be able to deflect radially, the membrane must be radially flexible and therefore be able to deflect in a radial direction relative to the valve axis. Therefore, the membrane must have little resistance to radial deformation. In order to provide the membrane with a desired deflection profile upon activation, the membrane may be provided with one or more bracing peripheral rings spaced apart between the attachment end and the maneuvering end of the membrane. For this purpose, the membrane may also be arranged with one or more buckle locators, for example weak corrugations, which localize desired deflection regions of the membrane.

The membrane may also be braced axially by being arranged with a certain axial rigidity, for example by means of axially extending corrugations or folds, yielding a certain resistance to radial deflection. Thereby, the membrane may exert a firm closing force on the sealing member when the membrane is at rest in its inactive position, in which the valve is in its closed position. If the membrane also is provided with an adapted elastic rigidity through appropriate choice of membrane material and geometric shape, an activated membrane will also possess sufficient stored energy in the form of resiliency to be able to push the sealing member back into its valve-closing position when the underpressure acting on the membrane ceases. Thus, the membrane may be provided with one or more axial braces. For this purpose, the membrane, when viewed in cross-section, may also be arranged into a hexagonal shape, a star shape, a wave shape etc., which has an axial bracing effect. Alternatively, the sealing member may be connected to a separate spring element urging the sealing member pressure-sealingly towards said opening in the partition wall of the valve device when the membrane is in its position of rest.

The membrane may also be formed asymmetrically about its valve axis, including its attachment end and/or maneuvering end. It may also have an asymmetrically positioned sealing member arranged thereto.

Preferably, the membrane is formed of a thin-walled plastics material. It may also be formed of different types of plastics materials suitably combined to achieve suitable properties in the relevant membrane structure.

BRIEF DESCRIPTION OF THE DRAWINGS

In the following, different exemplary embodiments of the invention will be shown, in which.

Furthermore, the figures may be somewhat distorted.

DETAILED DESCRIPTION OF THE INVENTION

Figure 1A:
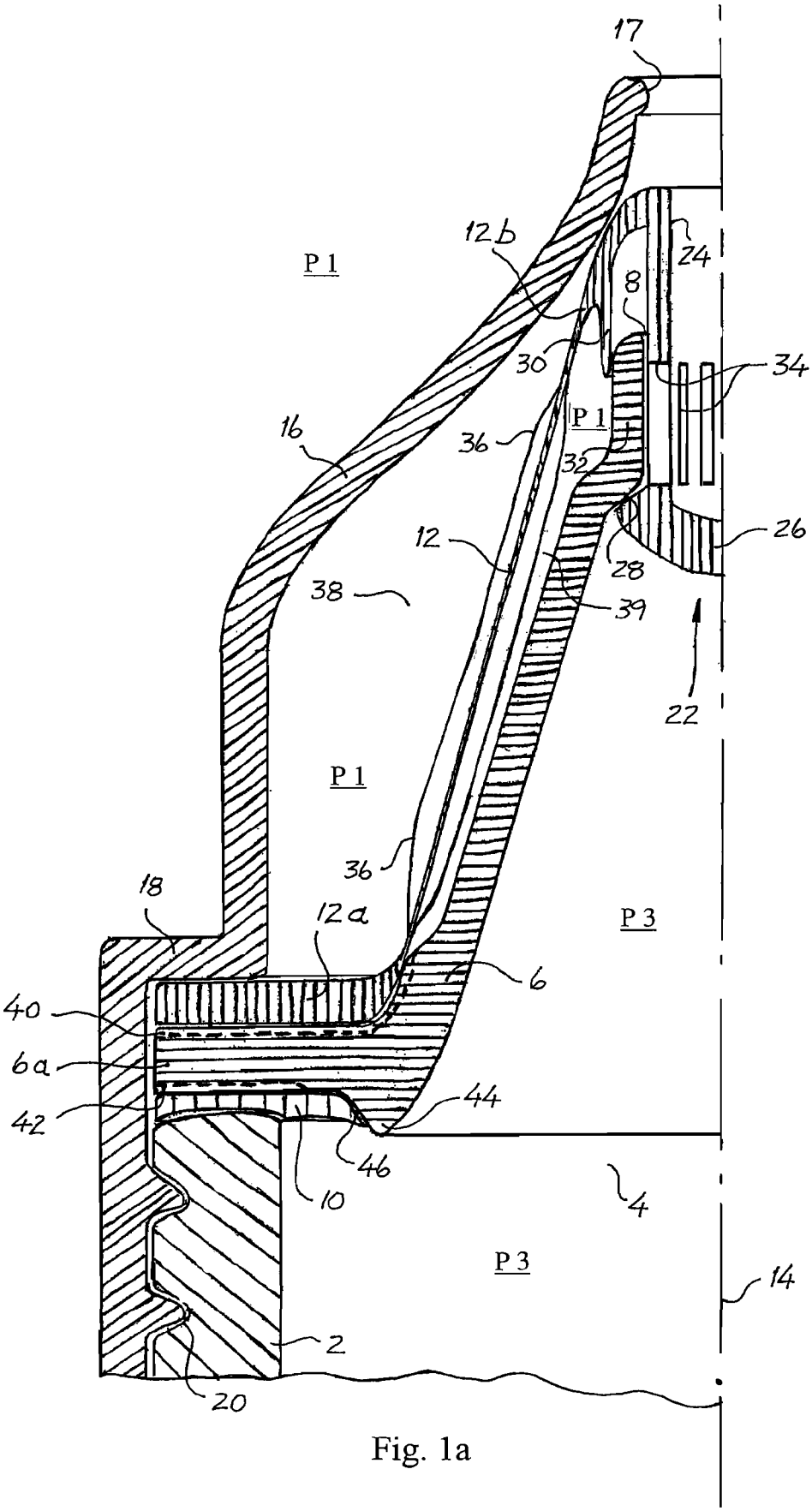
FIG. 1*a* shows a conically shaped membrane in its position of rest while an associated sealing member is placed in a valve-closing position, the membrane being arranged for outward radial movement upon underpressure-activation.
Figure 1B:
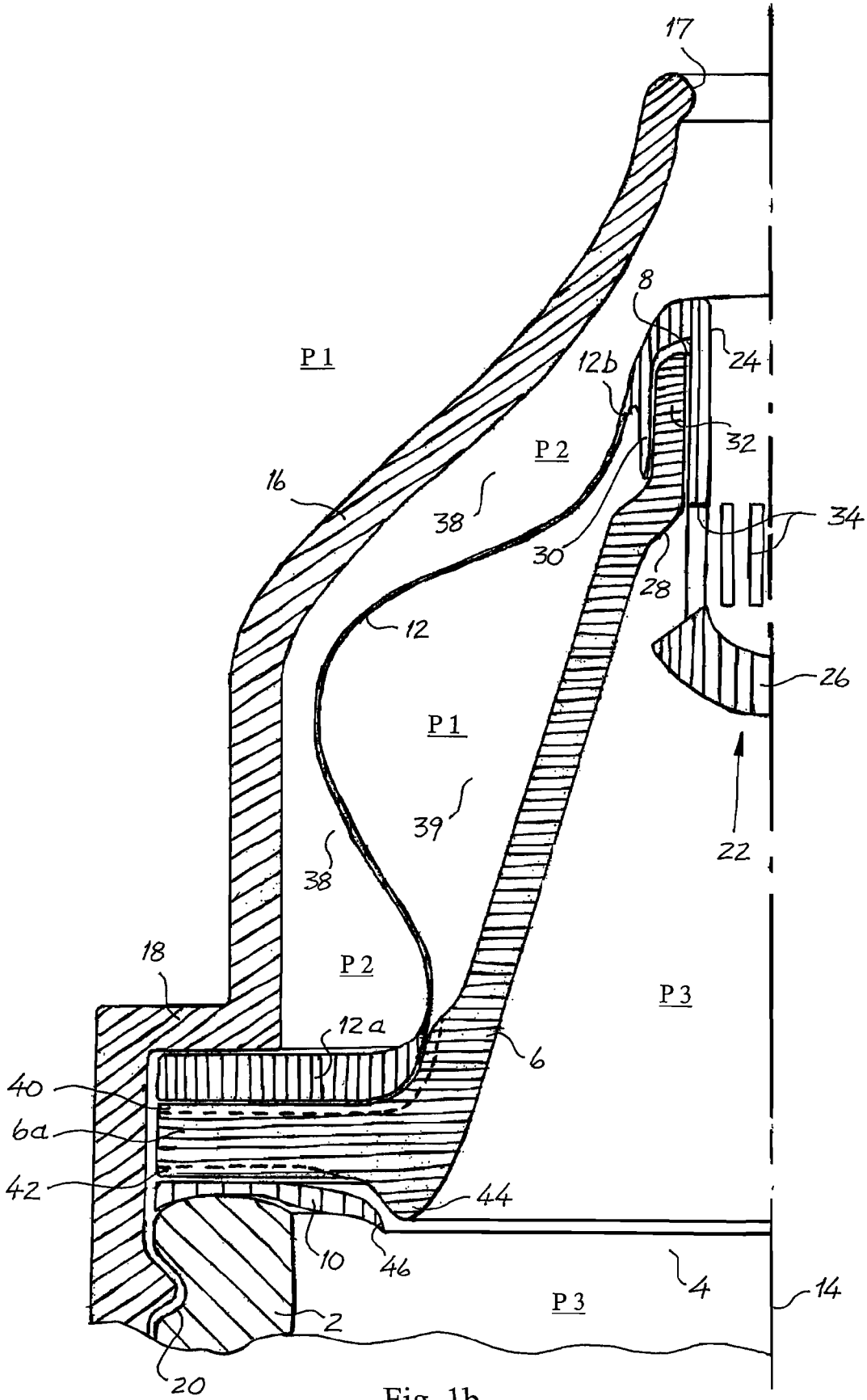
FIG. 1*b* shows the membrane according to FIG. 1*a* in an activated and expanded position while the sealing member is placed in its valve-opening position.

FIG. 1*a* and FIG. 1*b* show a bottle 2 with a bottle opening 4, to which is connected an opening-force-maximizing valve device according to the invention. A pressure P3 exists inside the bottle 2, whereas the bottle is surrounded by an atmospheric pressure P1. Among other things, the valve device includes a conical partition wall 6 with a peripheral circumferential rim 6*a* and a wall opening 8, the partition wall 6 being connected to the bottle 2 and pressure-sealingly enclosing the bottle opening 4 via a ring gasket 10.

This valve device also includes a peripherally continuous conical membrane 12. The membrane 12 is arranged external to the bottle 2 and is concentric about a valve axis 14 onto the partition wall 6 and through the valve opening 8. Moreover, all valve components in this and subsequent exemplary embodiments are concentric about the valve axis 14. Further, the membrane 12 has an axial extent relative to the valve axis 14, whereby the membrane 12 has two axial termination ends, comprising an attachment end 12*a* and a maneuvering end 12*b*. The attachment end 12*a*, which in this example consists of a peripheral circumferential rim, is connected to the outside of the circumferential rim 6*a* of the partition wall 6. The attachment end 12*a* and the circumferential rim 6*a* are attached to the bottle opening 4 by means of a drinking spout 16 with a drinking opening 17 and an internally threaded base 18 matching external threads 20 on the bottle 2. The maneuvering end 12*b*, which is movable, is placed at an axial distance from the attachment end 12*a*, and it is connected in a tensile-force-transmitting manner to an axially movable valve sealing member 22. In this exemplary embodiment, the sealing member 22 forms an extension of the maneuvering end 12*b* being formed as a sealing member 22. This provides for great technical advantages when producing the valve device in connection with the drinking spout 16 for the bottle 2. Thereby, the membrane 12 and the sealing member 22 may be produced in one valve piece and of the same material, which simplifies the production process and provides for economic advantages. In terms of production, this one valve piece may possibly be delivered assembled together with the partition wall 6, which further simplifies the subsequent assembling of the valve device and the associated drinking container.

The sealing member 22 consists of an axially extending, flow-through stay 24. One end of the stay 24 is shaped and widened like a valve head 26 placed on the inside of the partition wall 6, and bearing pressure-sealingly against a valve seat 28 in the partition wall 6 when at rest, cf. FIG. 1*a*. The other end of the stay 24 is formed with an external guide sleeve 30 being open in the direction of the valve seat 28, and being connected to the membrane 12. At its wall opening 8, the partition wall 6 is shaped as an axial guide collar 32, which the guide sleeve 30 encloses in a complementary manner, whereby they form an axial guide for the sealing member 22. A peripheral region of the stay 24 is also provided with through slots 34 for fluid outflow when the present valve is open. When the membrane 12 is in its position of rest, the slots 34 are positioned directly opposite the guide collar 32, cf. FIG. 1*a*, whereas they are displaced axially into the bottle 2 when the membrane 12 is activated, cf. FIG. 1*b*.

The membrane 12 is shaped as a longitudinal, conical bellows with axially extending folds 36 distributed along its circumference; cf. FIG. 1*a*.

The membrane 12 is also arranged to move radially outwards from the valve axis 14, as shown in FIG. 1*b*. As a consequence of this membrane structure, a suction chamber 38 exists between the membrane 12 and said drinking spout 16. The membrane 12 is activated when a user sucks an underpressure P2 in the suction chamber 38. Among other things, the underpressure P2 must be sufficiently large to overcome the repose resistance of the membrane 12, the repose resistance representing a given elastic stiffness of the membrane 12 when at rest and resulting from the membrane material, dimensioning, shape and construction thereof. When the underpressure P2 overcomes the repose resistance, the membrane 12 contracts axially, moving the sealing member 22 inwards in the bottle 2, whereby the valve opens. Thereby, a maximum opening force is transmitted to the sealing member 22 during incipient opening of the valve. Simultaneously, atmospheric pressure P1 is admitted into a pressure equalizing chamber 39 via suitable vents, the chamber 39 being located between the partition wall 6 and the membrane 12.

In FIGS. 1*a* and 1*b*, said vents consist of a suitable number of radial venting grooves 40 formed on the outside of the circumferential rim 6*a* of the partition wall 6. Corresponding radial venting grooves 42 are formed on the inside of the circumferential rim 6*a* for admitting air into the interior of the bottle 2, cf. FIG. 1*b*. Alternatively, said ring gasket 10 is provided with corresponding grooves (not shown) for air admission purposes. The grooves 40, 42 must be sufficiently narrow in order not to affect the sealing function around the bottle opening 4, but they must be deep enough to allow atmospheric air pressure P1 to pass through them.

The inside of the partition wall 6, at its circumferential rim 6*a*, is also provided with a concentric, axially projecting sealing edge 44. The ring gasket 10 may pressure-seal against the sealing edge 44 whenever the pressure P3 within the bottle 2 equals or exceeds the ambient pressure P1. For this purpose, the ring gasket 10 is provided with an elastically biased inner lip edge 46 bearing pressure-sealingly, when at rest, against the sealing edge 44. In contrast, when the pressure P3 in the bottle 2 becomes lower than the ambient pressure P1, for example when consuming fluid from the bottle 2, the ambient pressure P1 will force air through the grooves 42 and push the lip edge 46 away from the sealing edge 44, thereby admitting air into the bottle 2.

Figure 2A:
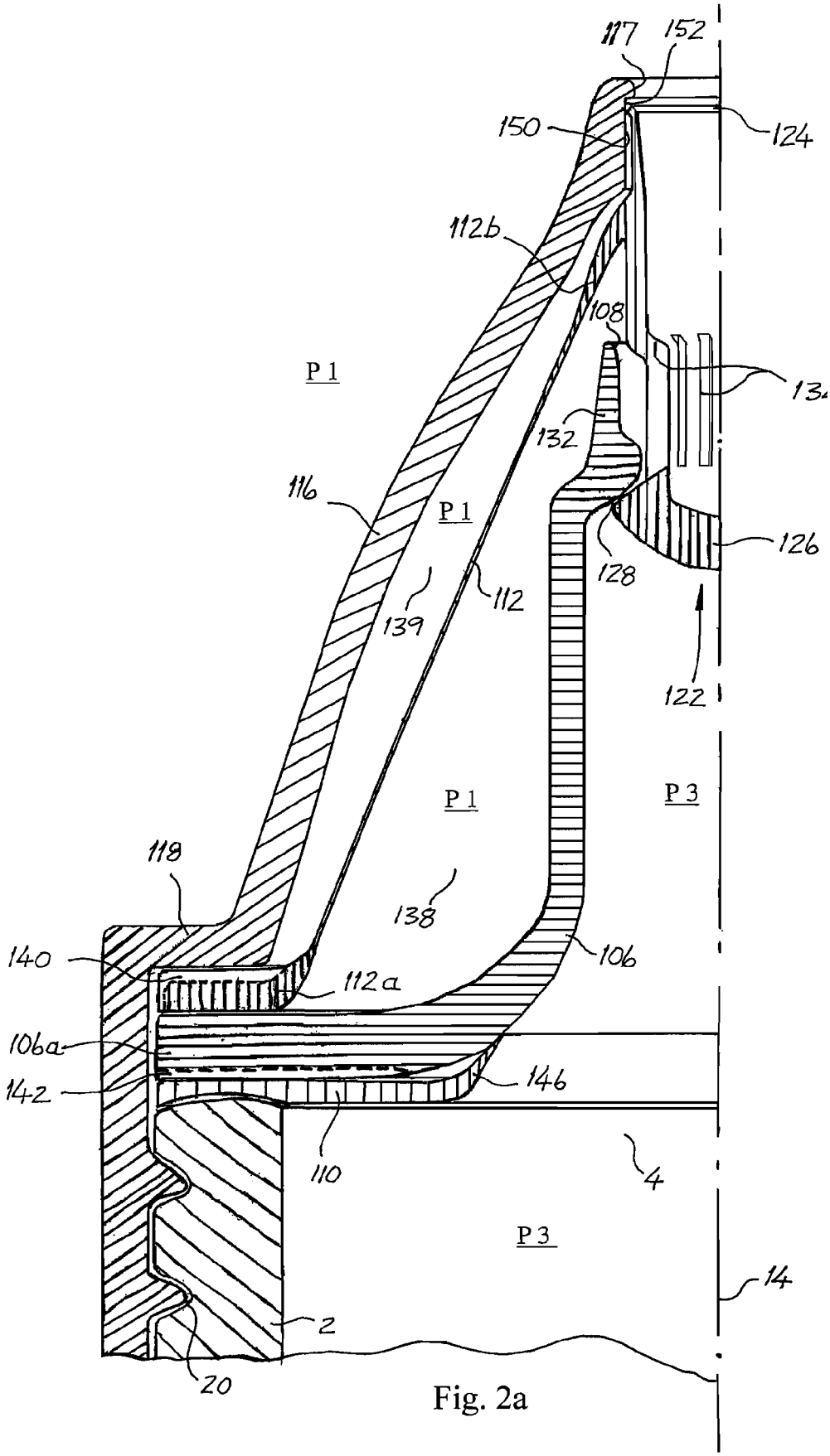
FIG. 2*a* shows a conically shaped membrane in its position of rest while an associated sealing member is placed in a valve-closing position, the membrane being arranged for inward radial movement upon underpressure-activation, and the membrane being provided with buckle locators providing the membrane with a desired deflection profile upon activation (buckle locators not shown)
Figure 2B:
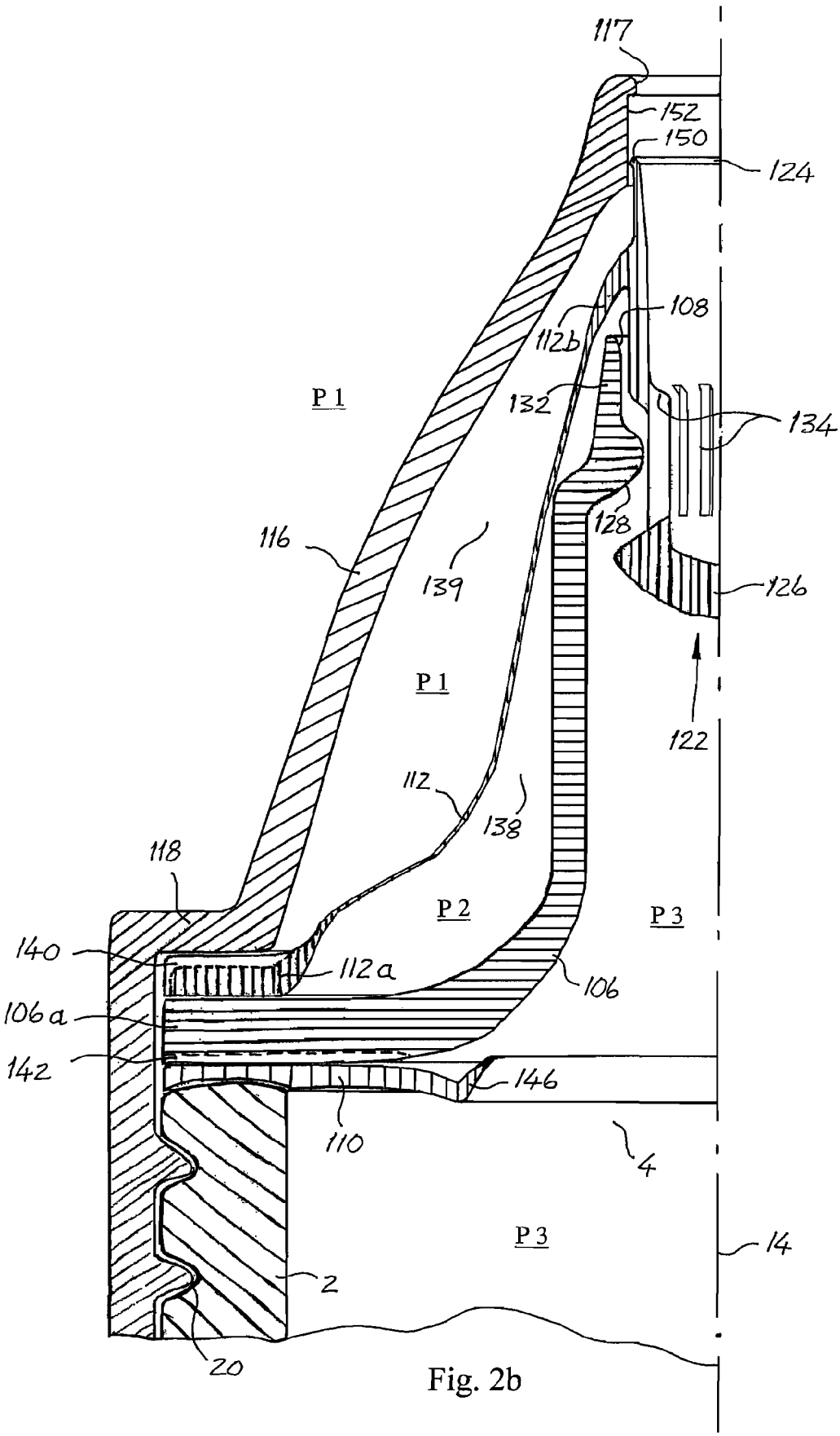
FIG. 2*b* shows the membrane according to FIG. 3*a* in its activated and radially contracted position while the sealing member is placed in a valve-opening position.

A second embodiment of the valve device according to the invention is shown in FIG. 2*a* and FIG. 2*b*. Wherever possible, the same reference numerals have been used for like parts with the addition of the prefix "1". Also this valve device is provided with a peripherally continuous, conically shaped membrane 112, which, as opposed to the previous membrane 12, is arranged for inward radial movement upon underpressure-activation. Therefore, the suction chamber 138 is placed on the inside of the membrane 112, whereas its pressure equalizing chamber 139 is placed on the outside thereof. The partition wall 106 is cylindrically shaped to allow the membrane 112 to move radially when activated. The admission of air into the suction chamber 138 takes place through radial venting grooves 140 formed on the outside of the attachment end 112*a* of the membrane 112. An axially movable sealing member 122 is connected to the maneuvering end 112*b* of the membrane 122. The sealing member 112 consists of a axially extending, flow-through stay 124, one end thereof being shaped as a widened valve head 126 that, when at rest and when the membrane 112 is inactive, bears pressure-sealingly against a cam-shaped valve seat 128 on the inside of the partition wall 106, cf. FIG. 2*a*. Moreover, the wall opening 108 of the partition wall 106 is shaped as an axially extending, widened collar 132, the internal diameter of which is larger than the external diameter of slots 134 of the stay 124. At rest, in their valve-closing position, the slots 134 are placed directly opposite the collar 132, forming connecting openings between said suction chamber 138 and a drinking opening 117, cf. FIG. 2*a*. At its other end, the stay 124 is formed with an external guiding edge 150 being axially movable within a circular guide 152 formed internally in the drinking opening 117 of the drinking spout 116. When moving axially, the stay 124 is supported laterally by the guide 152 and by the cam-shaped valve seat 128. In said position of rest, an elastically biased, inner lip edge 146 of a ring gasket 110 is also pressed pressure-sealingly against the partition wall 106. When the valve opens, the sealing member 122 is pushed axially inwards into the bottle 2, whereby fluid may flow out through the pushed-in slots 134. During fluid consumption, the ambient pressure P1 will force air through venting grooves 142 on the inside of the circumferential rim 106*a* and push the lip edge 146 away from the partition wall 106, cf. FIG. 2*b*, thereby allowing air to pass and enter into the bottle 2.

Figure 3A:
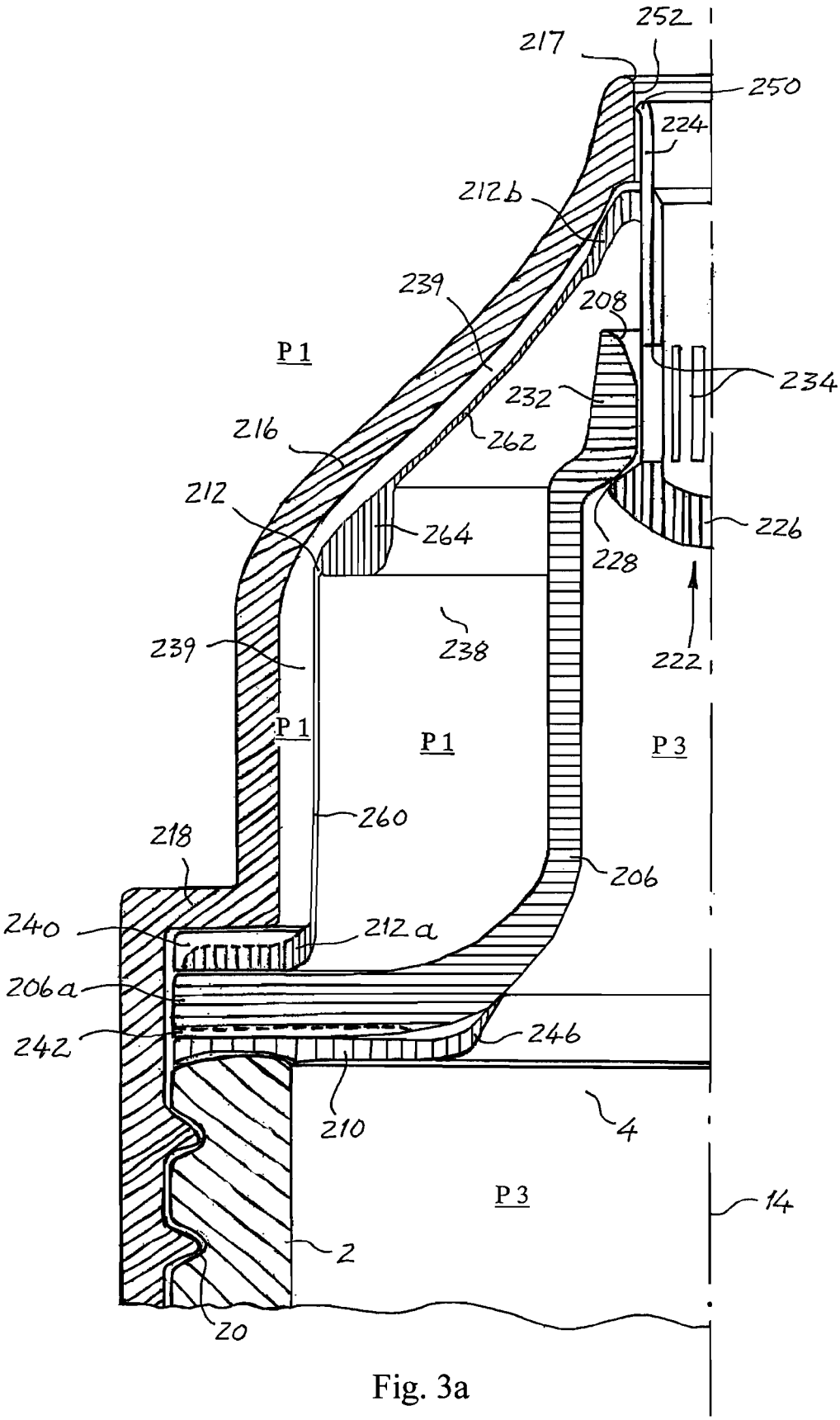
FIG. 3*a* shows a partly cylindrically and partly conically shaped membrane in its position of rest while an associated sealing member is placed in a valve-closing position, the membrane being arranged for inward radial movement upon underpressure-activation, and the membrane being provided with a bracing peripheral ring that divides the membrane into said cylindrical and conical portions.
Figure 3B:
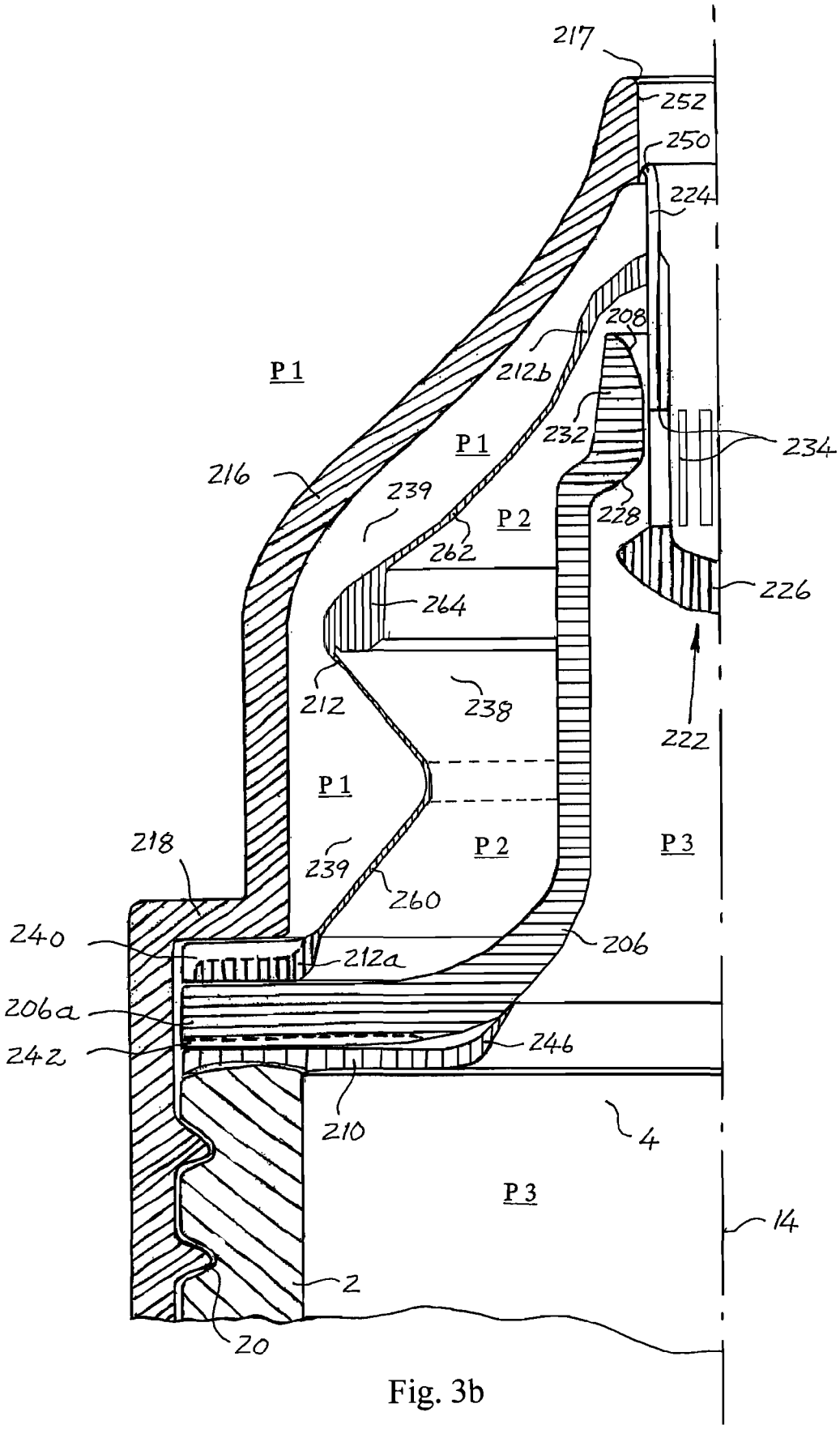
FIG. 3*b* shows the membrane according to FIG. 3*a* in its activated and radially contracted position while the sealing member is placed in a valve-opening position, said cylindrical membrane portion causing the largest radial buckling and the largest axial contraction.

A third embodiment of the valve device according to the invention is shown in FIG. 3*a* and FIG. 3*b*. Wherever possible, the same reference numerals have been used for like parts with the addition of the prefix "2". Also this valve device is arranged for inward, radial movement and operates essentially in the same manner as the previous valve device. The device according to FIG. 3*a* and FIG. 3*b*, however, is provided with a membrane 212 consisting of a cylindrical membrane portion 260 proximate its attachment end 212*a* and a conical membrane portion 262 proximate its maneuvering end 212*b*, cf. FIG. 3*a*. To provide the membrane 212 with a desired deflection profile upon activation, it is provided with a peripheral bracing ring 264 positioned between said membrane portions 260, 262. FIG. 3*b* shows the membrane 212 activated and deflected inwards towards the valve axis 14. The cylindrical membrane portion 260 is deflected the most and provides the largest axial membrane contraction. The device is arranged with an internal suction chamber 238 and an external pressure equalizing chamber 239 connected to the ambient pressure P1 via external, radial venting grooves 240 in its attachment end 212*a*. Also this device comprises a cylindrical partition wall 206 having, among other things, an axially extending collar 232, a sealing member 222 with a stay 224 essentially similar to the stay 124, and a ring gasket 210 corresponding to the ring gasket 110.

Although all exemplary embodiments are described for use on a bottle, it must be stressed that the valve device according to the invention may be adapted to all types of drinking containers, and to both pressurized and non-pressurized fluids.

The invention claimed is:

1. An opening-force-maximizing device of an underpressure-activated valve structured for connection to a drinking container having an outlet opening, said device comprising:

a partition wall provided with a wall opening and structured to be able to cover and pressure-sealingly enclose the outlet opening in the drinking container;

a peripherally continuous membrane positioned at an outside of the partition wall and subjected to ambient pressure, the membrane being arranged about a valve axis through the wall opening in the partition wall, the valve axis defining the axial direction of the underpressure-activated valve; and an axially movable valve sealing member connected to the membrane and provided with a valve head positioned upstream of the wall opening for the opening and closing thereof;

wherein an upstream side of the partition wall is provided with a valve seat formed around the wall opening for pressure-sealing and valve-closing contact with said valve head when the membrane is in an inactive position;

wherein the membrane has an axial extent so as to form a sleeve-like body having two axial termination ends represented by an attachment end and a maneuvering end;

wherein the attachment end is fixedly connected to the partition wall at a peripheral rim thereof;

wherein the movable maneuvering end is positioned at an axial distance from the attachment end and is connected in a tensile-force-transmitting manner to the valve sealing member;

wherein one side of the membrane is structured for receiving an underpressure which, together with said ambient pressure, creates a differential pressure across the membrane;

wherein the sleeve-like membrane, when in its inactive position, is arranged with a maximum axial extent;

wherein the membrane is radially flexible and therefore able to deflect in a radial direction relative to said valve axis; and wherein the membrane is arranged in a manner inhibiting axial stretching causing it to be insignificantly extendable in said axial direction when subjected to said differential pressure, which generates a tensile force in the membrane causing the membrane to contract axially and assume an active position, thereby causing a valve-opening, axial movement of the valve sealing member.

2. The device according to claim 1, wherein the maneuvering end is connected to a separate valve sealing member.

3. The device according to claim 1, wherein the valve sealing member forms an extension of the maneuvering end.

4. The device according to claim 1, wherein the membrane is of a cylindrical shape.

5. The device according to claim 1, wherein the membrane is of a conical shape.

6. The device according to claim 1, wherein the membrane is provided with a cylindrical membrane portion proximate its attachment end and a conical membrane portion proximate its maneuvering end.

7. The device according to claim 1, wherein the membrane is radially deflectable outwards from the valve axis.

8. The device according to claim 7, wherein a mid portion of the membrane is shaped as an axially extending bellows having axially extending folds.

9. The device according to claim 1, wherein the membrane is radially deflectable inwards towards the valve axis.

10. The device according to claim 9, wherein the membrane is provided with at least one peripheral bracing ring disposed between the attachment end and the maneuvering end of the membrane, whereby the membrane, upon activation, assumes a deflection profile determined by the at least one bracing ring.

11. The device according to claim 9, wherein the membrane is arranged with buckle locators in the form of axially extending corrugations or folds capable of yielding a certain resistance to radial deflection of the membrane, whereby the membrane, upon activation, assumes a deflection profile determined by the axial corrugations or folds.

12. The device according to claim 1, wherein the membrane is braced axially for it to yield a certain resistance to radial deflection, whereby the membrane, when inactive, exerts a firm closing force on the valve sealing member.

13. The device according to claim 12, wherein the membrane is provided with one or more axial braces.

14. The device according to claim 12, wherein the membrane, when viewed in cross-section, is arranged into a hexagonal shape, star shape or wave shape, which has an axially bracing effect.

15. The device according to claim 1, wherein the membrane is formed asymmetrically about the valve axis.

16. The device according to claim 1, wherein the valve sealing member and an edge of the wall opening are connected via a breakable seal capable of being broken upon first-time movement of the sealing member.

17. The device according to claim 10, wherein the membrane is arranged with buckle locators in the form of axially extending corrugations or folds capable of yielding a certain resistance to radical deflection of the membrane, whereby the membrane, upon activation, assumes a deflection profile determined by the axial corrugations or folds.

18. The device according to claim 7, wherein the membrane is braced axially for it to yield a certain resistance to radial deflection, whereby the membrane, when inactive, exerts a firm closing force on the valve sealing member.

19. The device according to claim 9, wherein the membrane is braced axially for it to yield a certain resistance to radial deflection, whereby the membrane, when inactive, exerts a firm closing force on the valve sealing member.

* * * * *